US006036570A

United States Patent [19]

Nadel

[11] Patent Number: 6,036,570

[45] Date of Patent: Mar. 14, 2000

[54] DRINKING CUP

[76] Inventor: Craig P. Nadel, 20 Tomalyn Hill Rd., Montville, N.J. 07045

[21] Appl. No.: 09/135,601

[22] Filed: Aug. 18, 1998

[51] Int. Cl.[7] ..... A63H 33/00

[52] U.S. Cl. ..... 446/74; 446/77; 446/242; 446/246; 446/266; 446/352

[58] Field of Search ..... 446/71, 72, 73, 446/74, 77, 81, 236, 242, 246, 265, 266, 330, 332, 352, 358; 215/396, 398, 400; 206/217, 457

[56] References Cited

U.S. PATENT DOCUMENTS

| | | | |
|---|---|---|---|
| 2,505,380 | 4/1950 | Blefeld | 446/74 |
| 2,635,384 | 4/1953 | Rosenthal | 446/71 |
| 2,663,866 | 12/1953 | Simpson | 446/74 |
| 4,765,465 | 8/1988 | Yamada et al. | 206/217 |
| 4,932,542 | 6/1990 | Chen et al. . | |
| 5,029,700 | 7/1991 | Chen . | |
| 5,105,940 | 4/1992 | Chen | 206/217 |
| 5,283,567 | 2/1994 | Howes | 206/217 |
| 5,419,436 | 5/1995 | Powell . | |
| 5,504,663 | 4/1996 | Tucker | 206/217 |
| 5,536,196 | 7/1996 | Sternberg | 446/81 |
| 5,687,497 | 11/1997 | Moore | 446/71 |
| 5,739,758 | 4/1998 | Driska et al. | 220/703 |
| 5,739,903 | 4/1998 | Kepner . | |
| 5,769,680 | 6/1998 | Hoffman . | |

*Primary Examiner*—Robert A. Hafer
*Assistant Examiner*—Jeffrey D. Carlson
*Attorney, Agent, or Firm*—Cohen, Pontani, Lieberman & Pavane

[57] ABSTRACT

Drinking containers having viewable elements. The containers comprise a receptacle portion adapted to receive a liquid and to dispense the liquid to a person, and a sealed compartment having a viewable, actuatable element therein which can be viewed. The drinking containers disclosed herein entertain people observing them. Since the viewable element provides a point of focus for the person drinking the liquid prior to, subsequent to and during drinking, a caregiver providing health or child care to the person will be able to attend to other matters since the person will be entertained by the drinking container.

6 Claims, 7 Drawing Sheets

DRINKING CUP

BACKGROUND OF THE INVENTION

1. Field of the Invention

This invention relates generally to drinking containers. More specifically, this invention relates to drinking containers with viewable elements.

2. Description of the Related Art

All parents and child caregivers constantly wrestle with the problem of providing children with sufficient liquids during the day to keep the children satisfied and healthy. Similarly, adolescents and adults that are disabled, retarded or have low intelligence quotients usually require maintenance and care that often involves administration of drinking liquids by health caregivers.

A common problem facing both children's caregivers and health caregivers arises when the children or disabled adolescents and adults must be physically and mentally occupied as they consume liquids. This is a particularly acute problem when only one caregiver is available for several children or disabled adults, since the caregiver cannot typically provide sufficient supervision to adequately oversee all of their charges simultaneously. Both children and disabled adults may have short attention spans, which prevent them from concentrating on consuming the liquids in a short time. Moreover, these individuals have a tendency to become easily distracted, thereby causing them to spill the liquids or preventing them from consuming the liquids completely.

Children and health caregivers are thus faced with the twin problems of administering liquids regularly, and of administering the liquids in a safe, effective and convenient manner. There does not exist in the art today a drinking container, which can assist children and health caregivers in administering liquids.

Prior drinking containers have also not provided much in the way of entertainment value. Apart from having highly decorative colors and shapes, and funny or thought provoking logos or text, the prior drinking containers simply do not have sufficient means for entertaining persons that are drinking liquids from them. In a party or sporting environment, for example, the prior drinking containers do not add any additional elements of fun or levity. Even in an office environment where office workers take occasional coffee breaks, these containers afford no kind of harmless distractions which would favorably contribute to a much needed, short diversion in an otherwise busy and stressful day.

SUMMARY OF THE INVENTION

The aforementioned problems are solved and long-felt needs met by drinking containers provided in accordance with the present invention. Preferably, the drinking containers comprise receptacle means for receiving liquids. Compartment means are provided in sealed engagement with the receptacle means for providing a liquid-tight compartment of the drinking container. Viewable means are provided, disposed substantially within the compartment means, for providing a viewable element viewable through said compartment means. Actuating means are provided, interfaced with the viewable means, for actuating the viewable means.

In another broad aspect of the invention, methods of manufacturing a drinking container are provided. The methods preferably comprise the steps of forming a receptacle that will hold liquid, forming a substantially liquid-tight compartment, placing a viewable element within the substantially liquid-tight compartment, and joining the receptacle with the substantially liquid-tight compartment.

In more preferable embodiments of the invention, the viewable elements are movable and can be actuated by persons drinking liquids from the drinking containers. Yet more preferably, the viewable elements provide stimulating sensory input to those drinking from the containers or playing with them, and others observing the containers.

Drinking containers and methods of manufacturing drinking containers provided in accordance with the present invention solve long-felt needs that exist in the art for efficient and convenient administration of drinking liquids. The drinking containers and methods of manufacturing drinking containers described and disclosed herein allow the liquids to be consumed quickly, and with minimal supervision. Furthermore, drinking containers of the present invention advantageously provide a point of attention for consumers of the liquids, which alleviates a tendency for these consumers to be distracted during drinking. Additionally, drinking containers provided in accordance with the present invention can provide entertainment value to people. Such long-felt needs have not previously been satisfied by the art as a whole.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE PRESENTLY PREFERRED EMBODIMENTS

Figure 1:
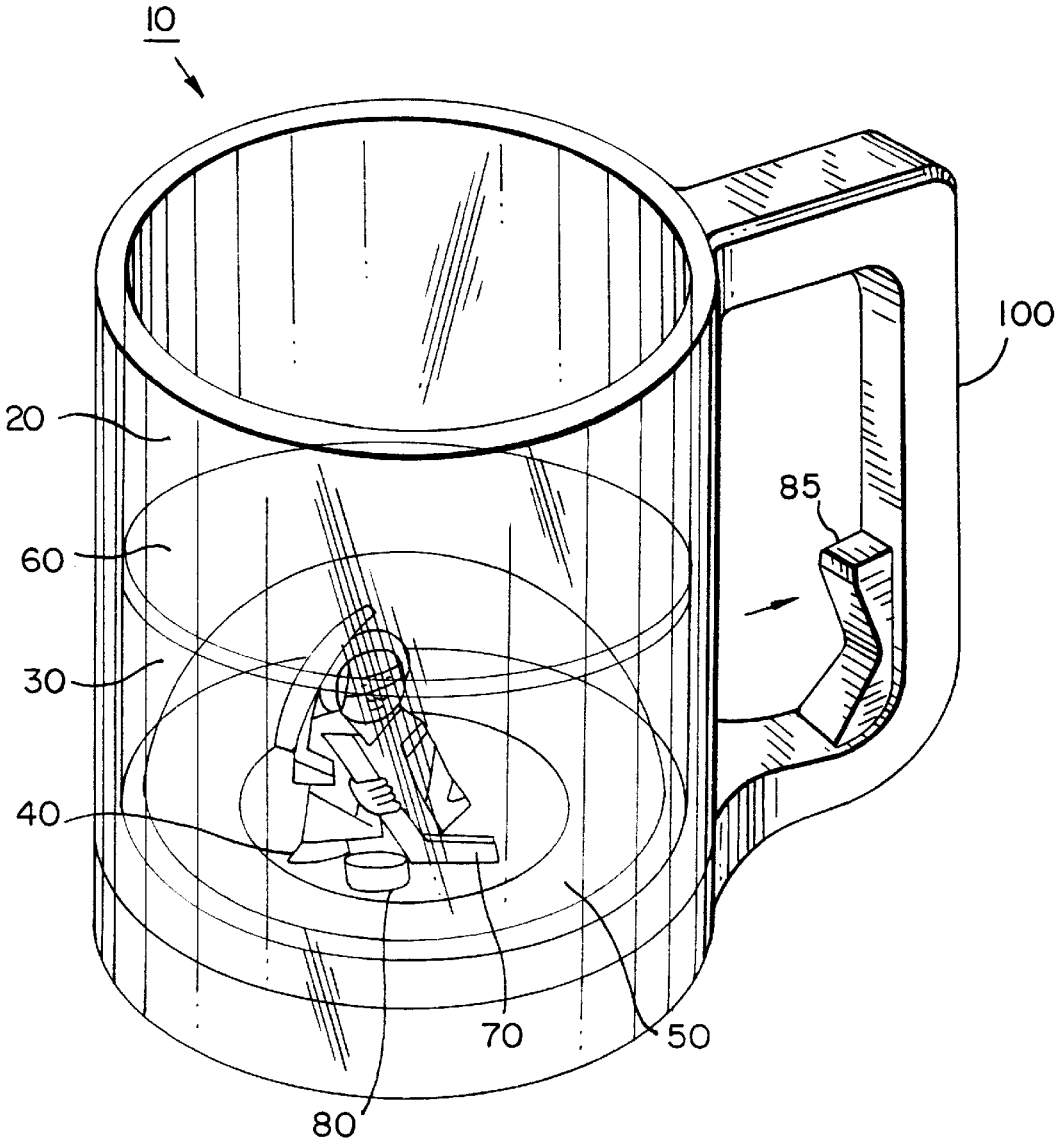
FIG. 1 is a perspective view of an embodiment of a drinking container provided in accordance with the present invention.

Referring now to the drawings wherein like reference numerals refer to like elements, and without intending to limit the invention in any way, FIG. 1 illustrates a preferred embodiment of a drinking container 10 provided in accordance with the present invention. The drinking container 10 comprises a cup or glass-like receptacle portion 20 that is adapted to receive a liquid and to dispense the liquid to a person when the person desires to drink the liquid. A sealed compartment 30 is in liquid-tight engagement with and within the receptacle portion 20. "Liquid-tight", as used herein, means that the sealed compartment 30 will not receive liquids, especially when liquids are poured into or drunk from the receptacle portion 20. It will be recognized by those with skill in the art, and particularly those skilled in manufacturing processes, that appropriate sealing methods and sealing materials should be used to achieve a substantially liquid-tight seal. Moreover, since it may be desired that the drinking containers provided in accordance with the present invention should be able to hold all of the possible hot, cold, alcoholic and non-alcoholic beverages that people consume, appropriate care should be taken in such circumstances to make sure that the liquid-tight seal between receptacle portion 20 and sealed compartment 30 is versatile enough to provide sealing for all such beverages. The drinking containers described and claimed herein can be made of any conventional materials used today to make cups, mugs, glasses, beer steins, and the like. Thus, any appropriate ceramic, plastic, glass or other material may be used.

A viewable element 40 is disposed substantially within the sealed compartment 20 and can be seen and examined by the person consuming the beverages both prior or subsequent to, and while, drinking. Other persons or spectators preferably can also see viewable element 40. As shown in the embodiment of FIG. 1, the viewable element is attached to the base 50 of the sealed compartment 30. However viewable element 40 may be attached to any portion of sealed compartment 30, and may even partially extend through the upper wall 60 of the sealed compartment into the receptacle portion so long as a proper, liquid-tight seal is maintained between the sealed compartment and the receptacle portion.

Viewable element 40 may be fixed to a place in sealed compartment 30 and remain completely stationary and immovable therein, or alternatively the viewable element may be provided with a range of possible motions, and be actuated by elements that will be described in more detail below. As will also be described in more detail below, viewable element 40 may have other types of sensory properties that will engage and entertain the person consuming beverages, and any spectators.

As illustrated in FIG. 1, viewable element 40 is a sports action figure, in this case a simulated hockey player carrying a hockey stick 70. A loose hockey puck 80 may be provided in proximity to hockey stick 70 so that when a trigger 85 on the drinking container actuates the hockey player, the hockey stick contacts and propels the hockey pock throughout sealed compartment 30. The hockey player embodiment of FIG. 1 is particularly appropriate for a sports bar or other sporting environment. It will be recognized by those skilled in the art that any type of viewable element can be utilized in accordance with the invention depending only upon the particular environment or persons to which the inventive drinking container is directed. Thus, for example, when the drinking container is directed to children, the viewable element might be a popular figure such as Winnie the Pooh™, or Mickey Mouse™. Collapsible toys, spinners, signs with logos and all other types of entertaining elements may also be used. Stationary viewable elements that light up or make sounds can also be used.

More than one viewable element may be located in sealed compartment 30, or more than one liquid-tight, sealed compartment, each having one or more viewable elements therein, could be disposed within receptacle portion 20. While the embodiment of FIG. 1 shows the sealed compartment as being substantially cylindrical in cross-section, it could be virtually any shape such as a box, sphere, dome or pyramid, for example. Additionally, messages, symbols, trademarks, service marks and logos may be etched or formed in the material of the sealed compartment, or the receptacle portion of the drinking container. Furthermore, the material of receptacle portion 20 or sealed compartment 30 may be completely transparent, or colored and therefore only partially transparent. Moreover, only sealed compartment 30 may be partially or completely transparent while receptacle portion 20 is opaque.

Figure 2:
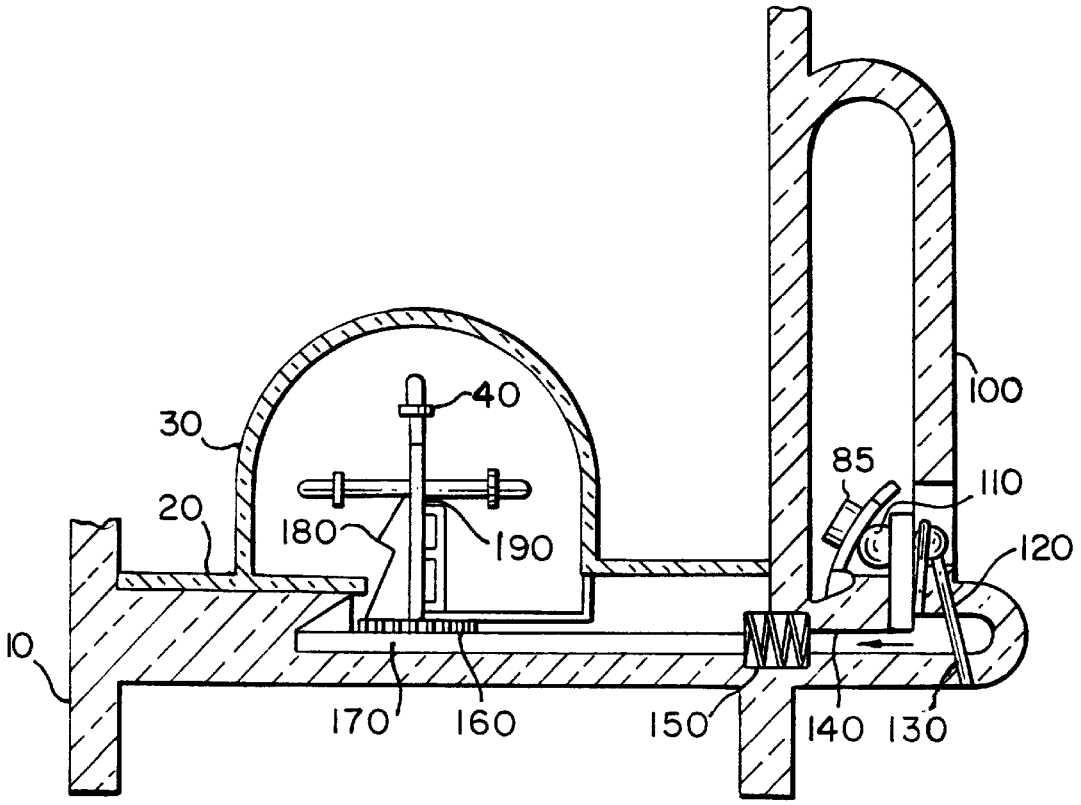
FIG. 2 is a breakaway, elevational view of an actuating mechanism for moving the viewable elements.

The drinking container has a conventional handle 100 that may be integrally molded with the receptacle portion 20 or sealed compartment 30. Trigger 85 is interfaced in and through handle 100, and is placed in mechanical contact with a mechanism that can actuate viewable element 40. Trigger 85 can be any kind of mechanical or electrical actuating element such as a lever, trigger, switch, toggle, dual pole switch or similar device, depending on the type of actuation required, if any. Referring by way of example to FIG. 2, when trigger 85 is pressed, a camming surface 110 on the interior, opposite side of button 85 actuates a leaf spring 120. The outer portion 130 of leaf spring 120 pushes a plunger 140 against a coiled spring 150 that actuates gear teeth 160 located on the distal end 170 of plunger 140. This causes a reciprocal gear to be actuated causing viewable element 40, in this case a spinner, to rotate on a shaft 190. A similar arrangement may be used when the viewable element is a conventional collapsible toy by replacing the gear teeth 160 and reciprocal gear 180 arrangement with an inclined cam surface on the distal end 170 of plunger 140 so that, when button 85 is pressed, the inclined cam surface rolls along a bottom surface of the collapsible, viewable element causing it to conventionally collapse.

Figure 3:
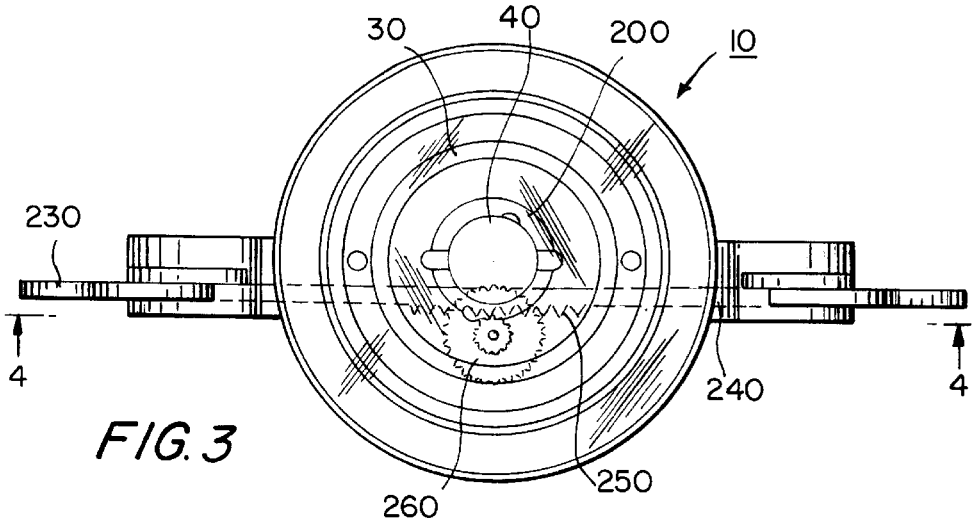
FIG. 3 is a top view of another embodiment of a drinking container provided in accordance with the present invention.
Figure 4:
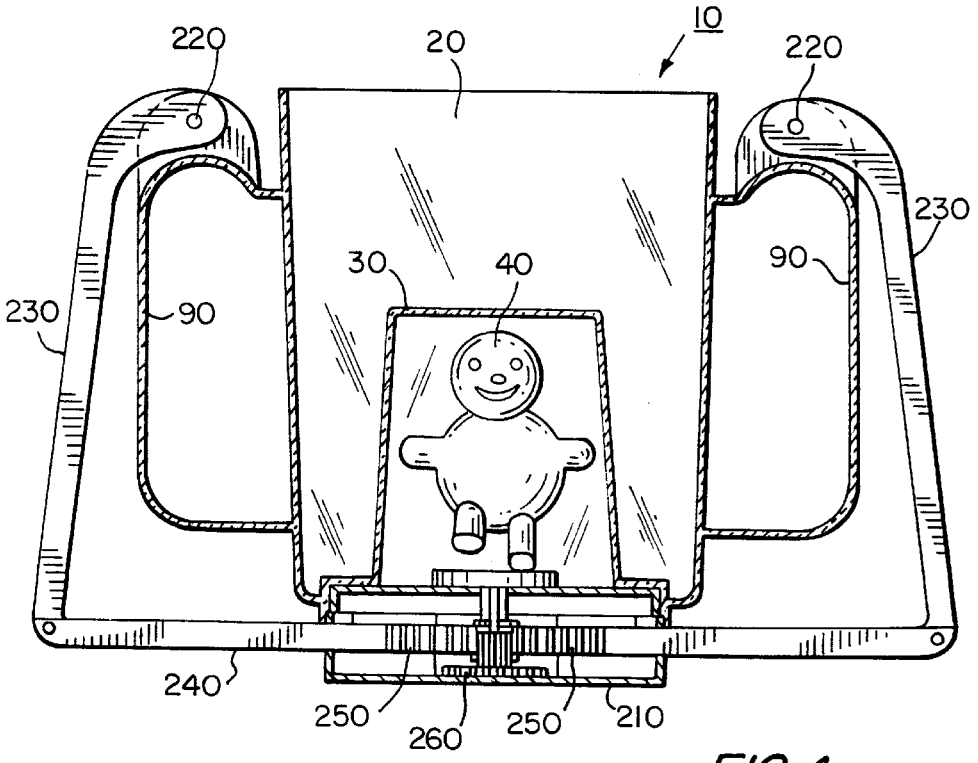
FIG. 4 is a cross-sectional view along the 4—4 line of FIG. 3.

Referring now to FIGS. 3 and 4, a rotatable, viewable element 40 is securely mounted on a platform 200. Rotatable, viewable element 40 is in operable connection with a moving assembly 210, which is rotatably connected to dual handles 90 of drinking container 10 at pivots 220. Moving assembly 210 preferably comprises a set of actuation arms 230, actuation bar 240, rack 250 and gear assembly 260.

Figure 5:
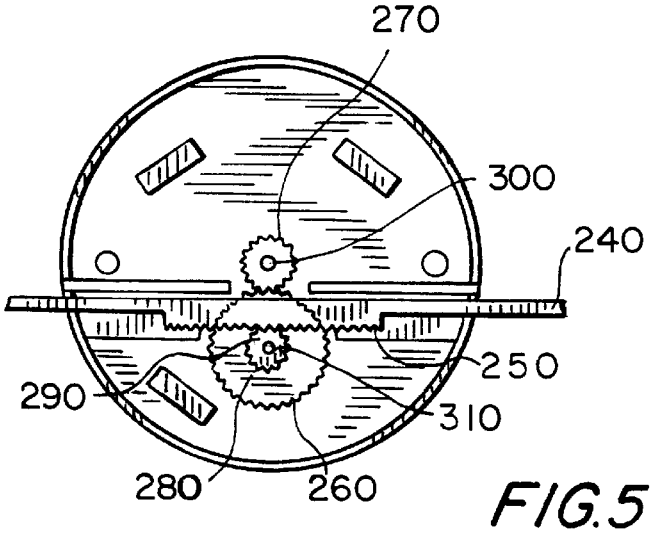
FIG. 5 is a bottom view of the drinking container of FIGS. 3 and 4.
Figure 6:
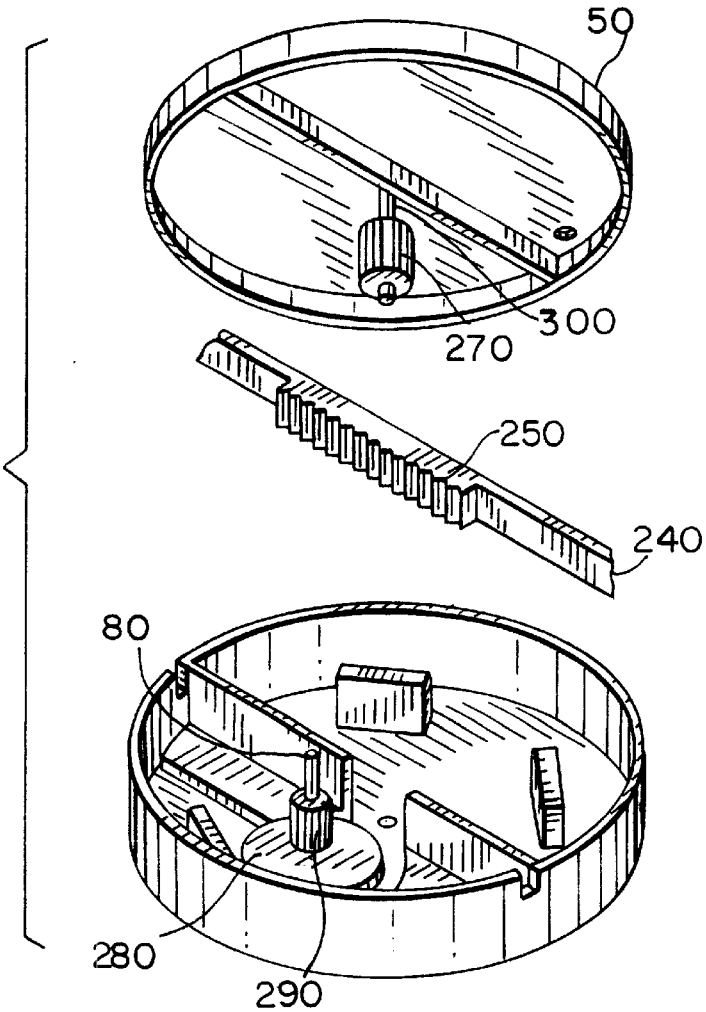
FIG. 6 is an exploded, perspective view of a gear assembly shown in FIG. 4.

Gear assembly 260 is illustrated in detail in FIGS. 5 and 6. Gear assembly 260 more preferably comprises meshed gears 270, 280 and 290. Gear 270 is mounted on one end of shaft 300. The opposite end of shaft 300 extends through sealed compartment base 50. A spindle 310 is connected to gears 280 and 290, that are attached to each other. Rack 250 is coupled to gear 290 such that lateral movement in rack 250 and actuation bar 240 causes gear 290 to rotate. Gear 60 is rotatably coupled to gear 280. Since gears 280 and 290 are attached to each other, any rotation in gear 290 causes rotation in gear 280. Likewise, since gear 280 is rotatably coupled to gear 270, any rotation is gear 280 causes rotation in gear 270.

Figure 7:
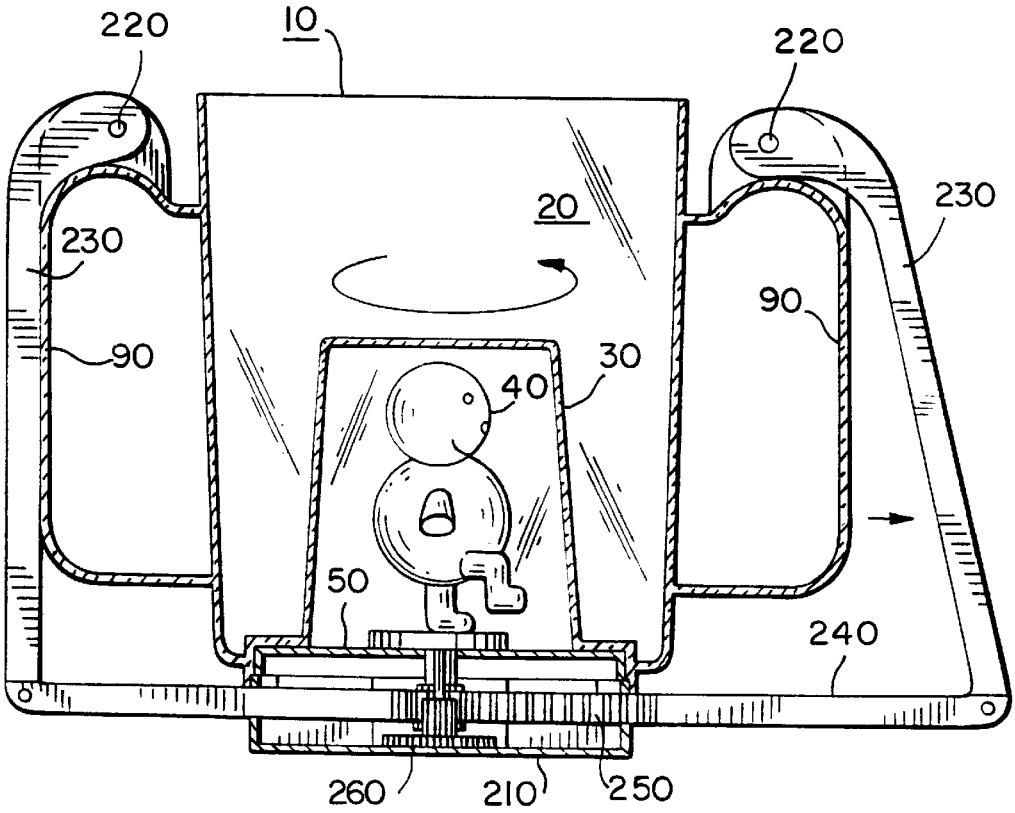
FIG. 7 is another cross-sectional view along the 4—4 line of FIG. 3 illustrating movement of the viewable element.

Referring now to FIG. 7, actuation bar 240 and rack 250 have been moved to the right as indicated. Since gears 270 and 280 are rotatably coupled to each other, rotation in gear 280 causes rotation in gear 270 and shaft 300 to which gear 270 is mounted. Since shaft 300 is attached to platform 200 on which viewable element 40 sits, the rotation of shaft 300 causes viewable element 40 to rotate. Alternatively, an electric motor may replace actuation arms 230. In this case, the electric motor causes lateral movement in actuation bar 240 and rack 250, thereby causing viewable element 40 to rotate. The electric motor is preferably a DC electric motor that can be powered by a conventional nine-volt battery or by one or multiple A, AA, AAA or C cells housed in the base of the drinking container.

Figure 9:
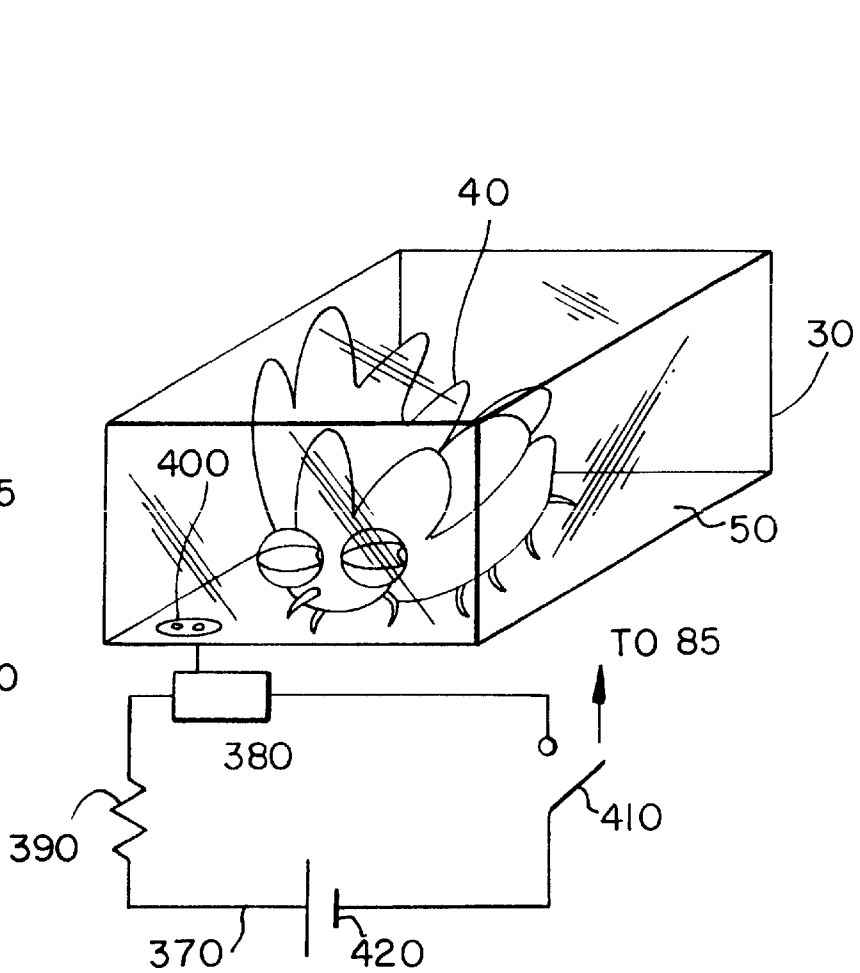
FIG. 9 is a schematic representation of the invention wherein a sound element is utilized.
Figure 8:
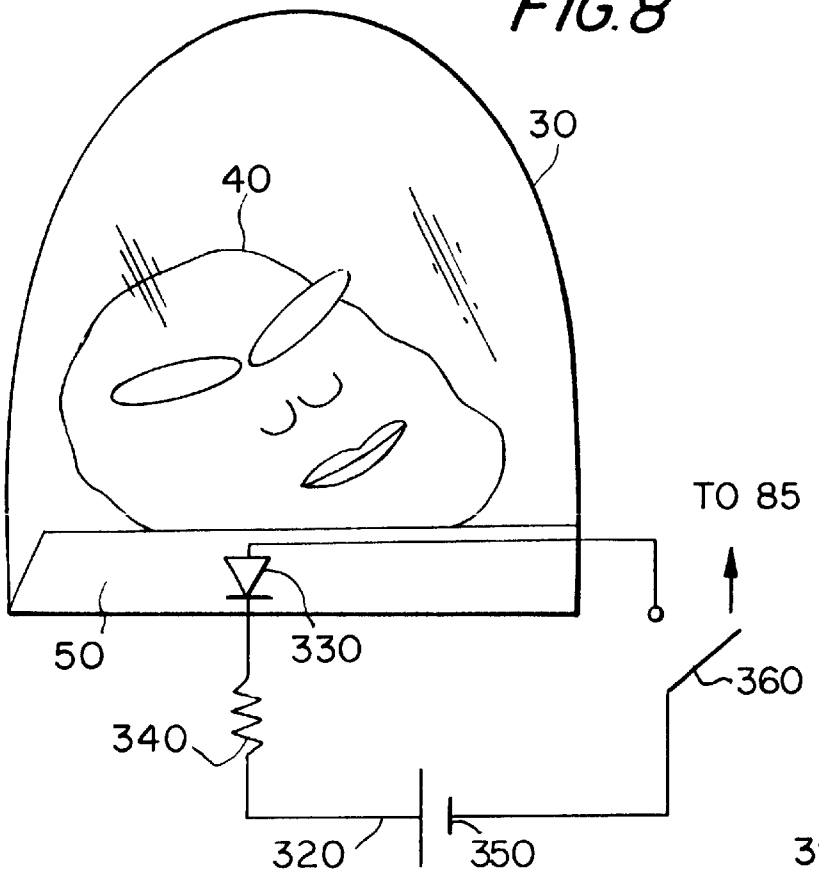
FIG. 8 is a schematic representation of the invention wherein a light emitting diode is utilized.

Referring to FIGS. 8 and 9, viewable elements 40 are stationary and fixed to the bases 50 of sealed compartment 30. In the embodiment of FIG. 8, viewable element 40 is in the form of a stylized, alien head of a translucent material with opaque eyes. A circuit, which is schematically represented at 320, is interfaced in the base of the sealed compartment of the drinking container. A light emitting diode 330 is buried in the translucent head portion of viewable element 40. When resistor 340 biases the light emitting diode 330, the diode lights up, thereby illuminating the translucent head portion and creating a pleasing, entertaining effect. Power supply 350 is turned on by electrical switch 360 that is connected to biasing resistor 340. Switch 360 is actuated by toggle switch 85, as is schematically represented in FIG. 8. Alternatively, with the addition of a resistor and capacitor discharge circuit, switch 360 could be replaced by a dual pole switch which need not be interfaced to a button or toggle switch 85 but which, when closed, causes the diode 330 to flash periodically, thereby producing a different kind of pleasing effect.

FIG. 9 illustrates yet another embodiment of a stationary, viewable element 40. In this embodiment the viewable element is a decorative bug. A circuit, which is schematically represented at 370, is similarly interfaced in the base 50 of sealed compartment 30, or of the drinking container. A sound chip 380 that electronically simulates the sound of a chirping bug is biased through resistor 390. When sound chip 380 is biased, it simulates the chirping sound of a bug that is output through a small speaker element 400. The speaker element may be an electronic part of the sound chip 380, or a separate element mounted in the sealed compartment, or elsewhere in the drinking container. When switch 410 is actuated by button 85, DC power supply 420 biases the biasing resistor 390 and turns on sound chip 380, thereby creating the pleasing sound effects that are desired.

Figure 10:
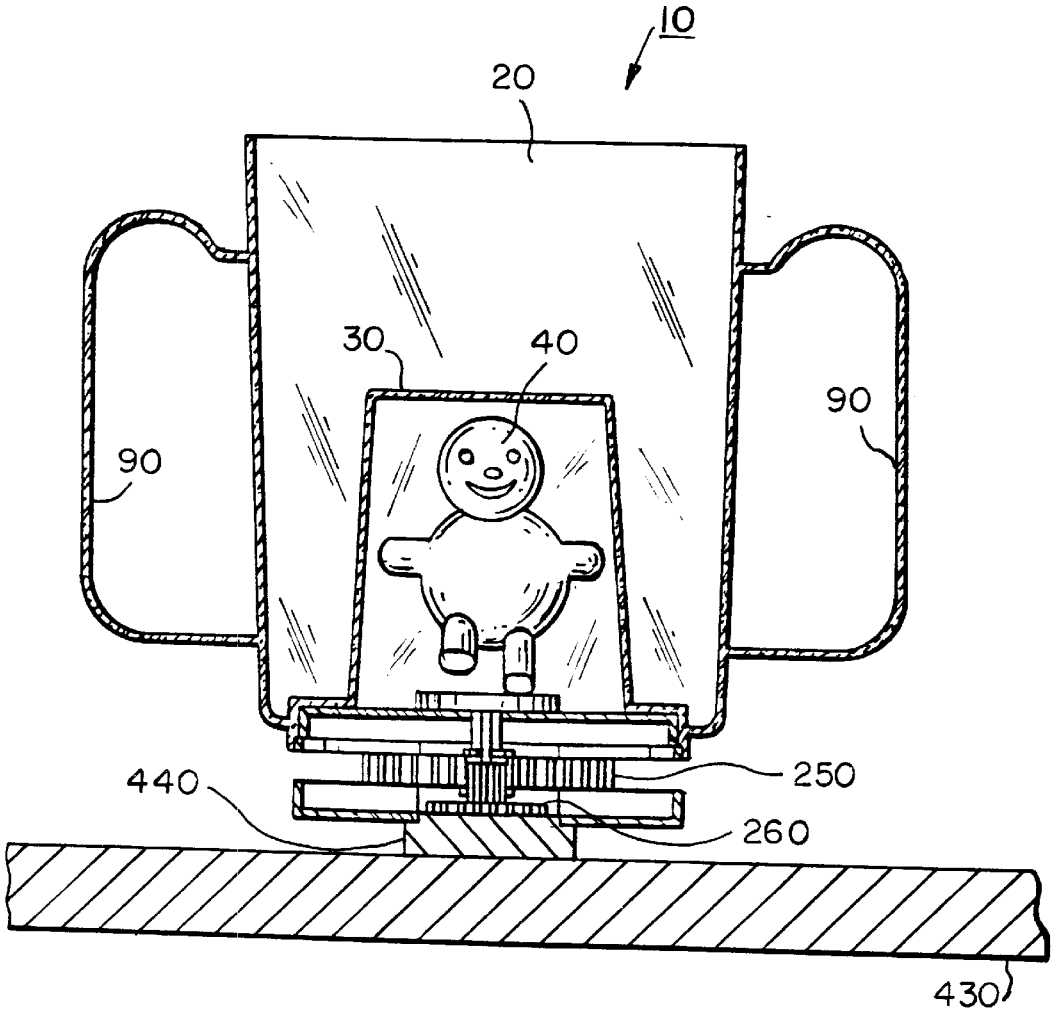
FIG. 10 is a cross-sectional view of another embodiment of a drinking container provided in accordance with the present invention wherein the viewable element is actuatable by a mechanism when the drinking container is placed on a surface.

FIG. 10 illustrates an embodiment of the invention wherein viewable element 40 is actuatable when drinking container 10 is placed on a surface 430. Preferably, an actuating mechanism 440 is interfaced with gear assembly 260. Actuating mechanism 440 is enabled when drinking container 10 is placed on surface 430 so that viewable element 40 rotates conventionally as discussed above without the need for the drinking container 10 to be held by a person. Alternatively, a DC motor may be interfaced with actuating mechanism 440 so that the viewable element 40 can rotate under electromechanical power as described previously. Viewable element 40 may also be provided with lighting devices such as light emitting diodes or sound chips that are also actuated by actuating mechanism 440.

The drinking containers provided in accordance with the present invention thus provide stimulating and pleasing devices for people observing or playing with them. These drinking containers also solve long-felt needs in the art for drinking containers that allow for simple and efficient administration of drinking liquids to patients and children. Use of the drinking containers claimed and described herein provide a point of focus for children and patients, thereby ensuring that the liquids are consumed quickly and with minimal supervision. The drinking containers with movable and stationary, viewable elements also provide entertainment value and relaxing distractions for those who drink from them, and play with them.

While there have been shown and described and pointed out fundamental novel features of the present invention as applied to a preferred embodiment thereof, it will be understood that various omissions and substitutions and changes in the methods described and in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. A drinking vessel providing user-controlled interactive entertainment for a user, comprising:

a vessel base;

a vessel sidewall upwardly depending from said base and defining with said base a receptacle for holding a liquid for selective ingestion by the user;

a closed entertainment compartment disposed within said receptacle and sealed against receipt from the receptacle of liquid contained within said receptacle, said compartment comprising a wall depending upwardly from said base and inwardly spaced within the receptacle from said vessel sidewall to permit liquid held in the receptacle to be present in a portion of said receptacle defined between said vessel sidewall and said compartment wall;

an entertainment article disposed within said entertainment compartment and for user-controlled predetermined motion of the entertainment article within said compartment;

an elongated member extending through and outwardly beyond said base and terminating at opposite ends of said member, said opposite ends of said member being disposed outwardly of and at respectively opposed sides of said base; and a pair of opposed user-graspable handles disposed exteriorly of said vessel sidewall and each comprising a first portion fixed to said sidewall and a second portion connected to a respective one of the opposite ends of said elongated member, said second portion of each said handle being movable relative to said first portion of said each handle to longitudinally reciprocally displace said elongated member within and through said base between said opposed handle second portions by selective user-controlled alternating manipulation of said opposed handles to move for each said handle said second portion relative to said first portion under selective user control;

operating means in said base and connecting said elongated member to said entertainment article to convert said longitudinally reciprocal displacement of said elongated member to said predetermined motion of said entertainment article and thereby effect said predetermined motion of the entertainment article when the user concurrently grasps said opposed handles and selectively alternately manipulates said opposed handles to longitudinally reciprocally displace said elongated member;

said vessel sidewall and said compartment wall being substantially transparent to enable ready viewing by the user, through said vessel sidewall and through said compartment wall and through liquid contained in said vessel, of said predetermined motion of the entertainment article in response to said user-controlled selective manipulation of the opposed handles.

2. A drinking vessel in accordance with claim 1, wherein said elongated member further comprises a rack defined on said member within said base, and wherein said operating means comprises a gear engaging said rack and rotatable through said longitudinal displacement of rack, said gear being connected to said entertainment article for rotating said article within said entertainment compartment in response to user-controlled selective alternating manipulation of said opposed handles to longitudinally displace said elongated member and thereby effect said predetermined motion of the entertainment article.

3. A drinking vessel in accordance with claim 2, wherein said operating means further comprises a post connected to said entertainment article in said entertainment compartment and to said gear in said base for transferring said rotation of the gear to said article.

4. A drinking vessel in accordance with claim 1, wherein said entertainment article comprises a figure constructed for selective collapsibility, and wherein said operating means comprises means connecting said elongated member and said entertainment article to alternately collapse and restore the entertainment article in said entertainment compartment to a noncollapsed condition in response to user-controlled selective alternating manipulation of said opposed handles to effect longitudinal reciprocating translation of said elongated member.

5. A drinking vessel in accordance with claim 1, wherein said second portion of each said opposed handle is connected between said first handle portion and one end of said elongated member for pivotal movement of said second handle portion relative to said first handle portion to effect said longitudinal translation of said elongated member and so that said first and second portions of each said handle are graspable within one hand of the user and said each handle is thereby selectively squeezable within the user's one hand to move said handle second portion relative to said handle first portion to effect said longitudinal translation of said elongated member under selective user control.

6. A drinking vessel in accordance with claim 1, wherein said compartment wall defines a closed cup sealingly affixed to said base to form said entertainment compartment within said wall and within which said entertainment article is disposed for ready viewing by the user and for said predetermined motion.

* * * * *